US007140072B2

(12) United States Patent
Leng

(10) Patent No.: US 7,140,072 B2
(45) Date of Patent: Nov. 28, 2006

(54) LOCKABLE LADDER HINGE

(75) Inventor: Lu Hao Leng, Xiamen (CN)

(73) Assignee: Cosco Management, Inc., Wilmington, DE (US)

( * ) Notice: Subject to any disclaimer, the term of this patent is extended or adjusted under 35 U.S.C. 154(b) by 28 days.

(21) Appl. No.: 10/985,818

(22) Filed: Nov. 10, 2004

(65) Prior Publication Data

US 2005/0121260 A1 Jun. 9, 2005

(51) Int. Cl.
*E05D 11/10* (2006.01)

(52) U.S. Cl. ..... 16/326; 182/163; 182/22

(58) Field of Classification Search ..... 16/326–329, 16/334, 321, 324; 403/93, 96, 101; 182/163, 182/22–26

See application file for complete search history.

(56) References Cited

U.S. PATENT DOCUMENTS

| | | | | |
|---|---|---|---|---|
| 3,048,883 | A | 8/1962 | Rizzuto | |
| 3,731,342 | A | 5/1973 | Cousin | |
| 3,811,151 | A | 5/1974 | Kuemmerlin | |
| 3,879,146 | A | 4/1975 | Mayer | |
| 4,152,810 | A | 5/1979 | Martinez | |
| 4,216,844 | A | 8/1980 | Klafs | |
| 4,403,373 | A | 9/1983 | Kümmerlin | |
| 4,407,045 | A | 10/1983 | Boothe | |
| 4,540,306 | A | 9/1985 | Wang | |
| 4,566,150 | A | 1/1986 | Boothe | |
| 4,666,327 | A | 5/1987 | Su | |
| 4,666,328 | A | 5/1987 | Ryu | |
| 4,697,305 | A | 10/1987 | Boothe | |
| 4,770,559 | A | 9/1988 | Yoo | |
| 4,773,503 | A * | 9/1988 | Purkapile | 182/22 |
| 4,890,950 | A | 1/1990 | Yoo | |
| 4,925,329 | A | 5/1990 | Chuang | |
| 4,928,792 | A * | 5/1990 | Krause | 182/163 |
| 5,018,405 | A | 5/1991 | Chiu | |
| 5,022,118 | A * | 6/1991 | Wan-Li | 16/327 |
| 5,026,198 | A * | 6/1991 | Lin | 403/27 |
| 5,058,239 | A * | 10/1991 | Lee | 16/324 |
| 5,954,157 | A | 9/1999 | Grimes et al. | |
| 6,086,284 | A | 7/2000 | Callahan | |
| 6,244,779 | B1 | 6/2001 | Slasinski | |
| 6,330,733 | B1 | 12/2001 | Rauschenberger | |
| 6,343,406 | B1 * | 2/2002 | Yeh | 16/328 |
| 6,688,797 | B1 | 2/2004 | Park et al. | |
| 2003/0012595 | A1 | 1/2003 | Park et al. | |
| 2003/0037412 | A1 | 2/2003 | Lee | |
| 2004/0129497 | A1 * | 7/2004 | Weiss | 182/163 |
| 2004/0216277 | A1 * | 11/2004 | Beaver | 16/324 |
| 2004/0226773 | A1 * | 11/2004 | Beaver et al. | 182/163 |
| 2005/0268434 | A1 * | 12/2005 | Burbrink et al. | 16/324 |

FOREIGN PATENT DOCUMENTS

| | | | |
|---|---|---|---|
| EP | 1 182 322 | A | 2/2002 |
| FR | 2 392 268 | A | 12/1978 |

* cited by examiner

*Primary Examiner*—Chuck Y. Mah
*Assistant Examiner*—Mark T. Vogelbacker
(74) *Attorney, Agent, or Firm*—Barnes & Thornburg LLP

(57) ABSTRACT

A lockable hinge includes a first and second hinge member, a lock, and an actuator. The lockable hinge is coupled to a pair of ladder-leg sections and is arranged to allow the ladder-leg sections to move among closed-ladder, trestle-ladder, and straight-ladder positions. The lock is used to lock the hinge members to cause the ladder-leg sections to lock in the closed-ladder, trestle-ladder and straight-ladder positions.

16 Claims, 13 Drawing Sheets

LOCKABLE LADDER HINGE

Foreign priority is hereby claimed under 35 U.S.C. § 119 to Chinese Patent Application No. 200320107059.8 filed in the People's Republic of China on Nov. 11, 2003, Chinese Patent Application No. 200420038624.4 filed in the People's Republic of China on Feb. 19, 2004, and Chinese Patent Application No. 200430030491.1 filed in the People's Republic of China on Feb. 24, 2004, the disclosures of which are hereby incorporated by reference herein.

BACKGROUND

The present disclosure relates to hinges and particularly to lockable hinges. More particularly, the present disclosure relates to lockable hinges for center-fold or multi-fold ladders.

Hinges are used in a variety of applications. Lockable hinges are often used on ladders to allow one section of the ladder legs to move relative to another section and to lock the ladder-leg sections in predetermined positions.

SUMMARY

According to the present disclosure, a lockable hinge includes a pair of hinge members adapted to be coupled to a pair of ladder-leg sections for movement of the ladder-leg sections among closed-ladder, trestle-ladder, and straight-ladder positions. The lockable hinge is used to lock the hinge members to cause the ladder-leg sections to lock in the closed-ladder, trestle-ladder, and straight-ladder positions.

Illustratively, the lockable hinge includes a lock and an actuator which, along with the hinge members, share a common pivot axis to allow pivotable movement of the ladder-leg sections about the common axis. The lock includes a pair of tabs that are biased to press inwardly toward the common axis against an annular flange portion of the first hinge member. The annular flange portion includes a plurality of tab-receiving spaces associated with the closed-ladder, trestle-ladder, and straight-ladder positions. Upon movement of the tabs into the lock-receiving spaces, the lock blocks pivotable movement of the first and second hinge members about the common axis to lock the ladder-leg sections in a selected position.

The actuator includes a rotary knob coupled to the lock. To unlock the hinge, an input force is applied to the knob to cause the tabs to move away from the common axis and away from the lock-receiving spaces. Upon retraction of the tabs from the lock-receiving spaces, the hinge members and the ladder-leg sections are able to pivot relative to one another to any of the other predetermined ladder positions.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which:

FIG. 6 is an enlarged side elevation view of the lockable ladder hinge, with portions broken away, showing the components of the rotary actuator aligned in an upright starting position to lock the ladder-leg sections in the closed-ladder (0°) position;

FIG. 7 is a side elevation view of the lockable ladder hinge, with portions broken away, showing the hinge unlocked for movement to the trestle-ladder (40°) position to establish the included angle of about 40° between the ladder-leg sections;

FIG. 8 is a side elevation view of the hinge, with portions broken away, showing the unlocked hinge in motion to the trestle-ladder (40°) position;

FIG. 9 is a side elevation view of the hinge, with portions broken away, showing the hinge in the trestle-ladder (40°) position;

FIG. 10 is a side elevation view of the lockable ladder hinge, with portions broken away, showing the hinge for movement from the trestle-ladder (40°) position toward the straight-ladder (180°) position;

FIG. 11 is a side elevation view of the lockable ladder hinge, with portions broken away, showing the unlocked hinge moving from the trestle-ladder (40°) position to the straight-ladder (180°) position;

FIG. 12 is a side elevation view of the lockable ladder hinge, with portions broken away, showing the hinge locked in the straight-ladder (180°) position;

DETAILED DESCRIPTION

Figure 2:
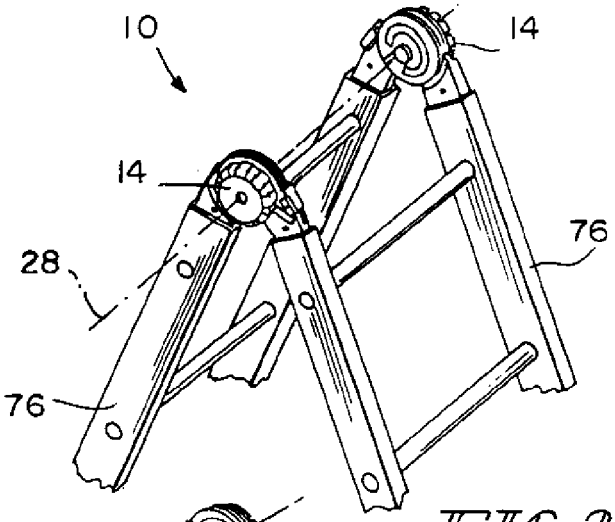
FIG. 2 is a perspective view of the ladder of FIG. 1, with portions broken away, showing the ladder-leg sections unfolded to a trestle-ladder position and the lockable ladder hinge locked to establish an included angle of about 40° between the ladder-leg sections.
Figure 1:
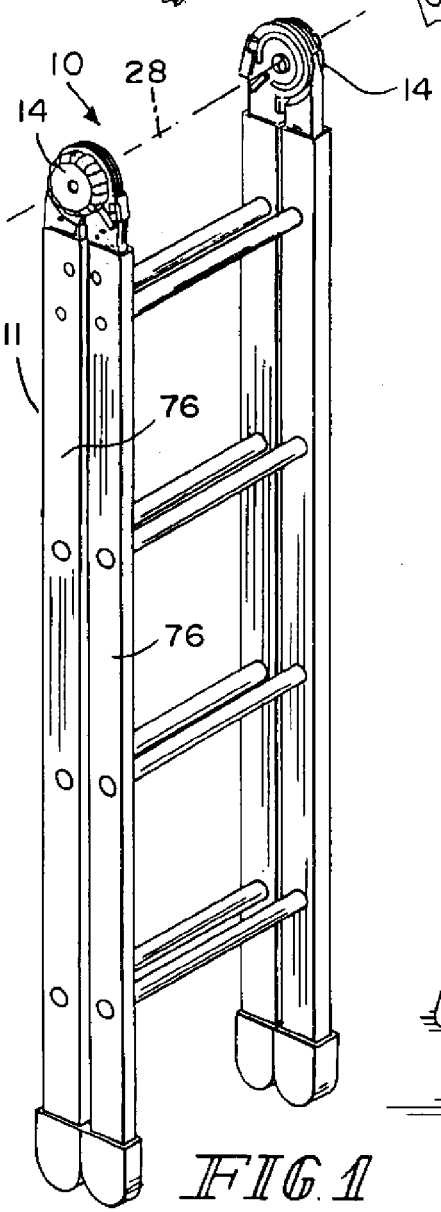
FIG. 1 is a perspective view showing a two-section ladder including a lockable ladder hinge that is positioned in a closed-ladder position and locked to establish an included angle of 0° between first and second sections of the ladder.
Figure 3:
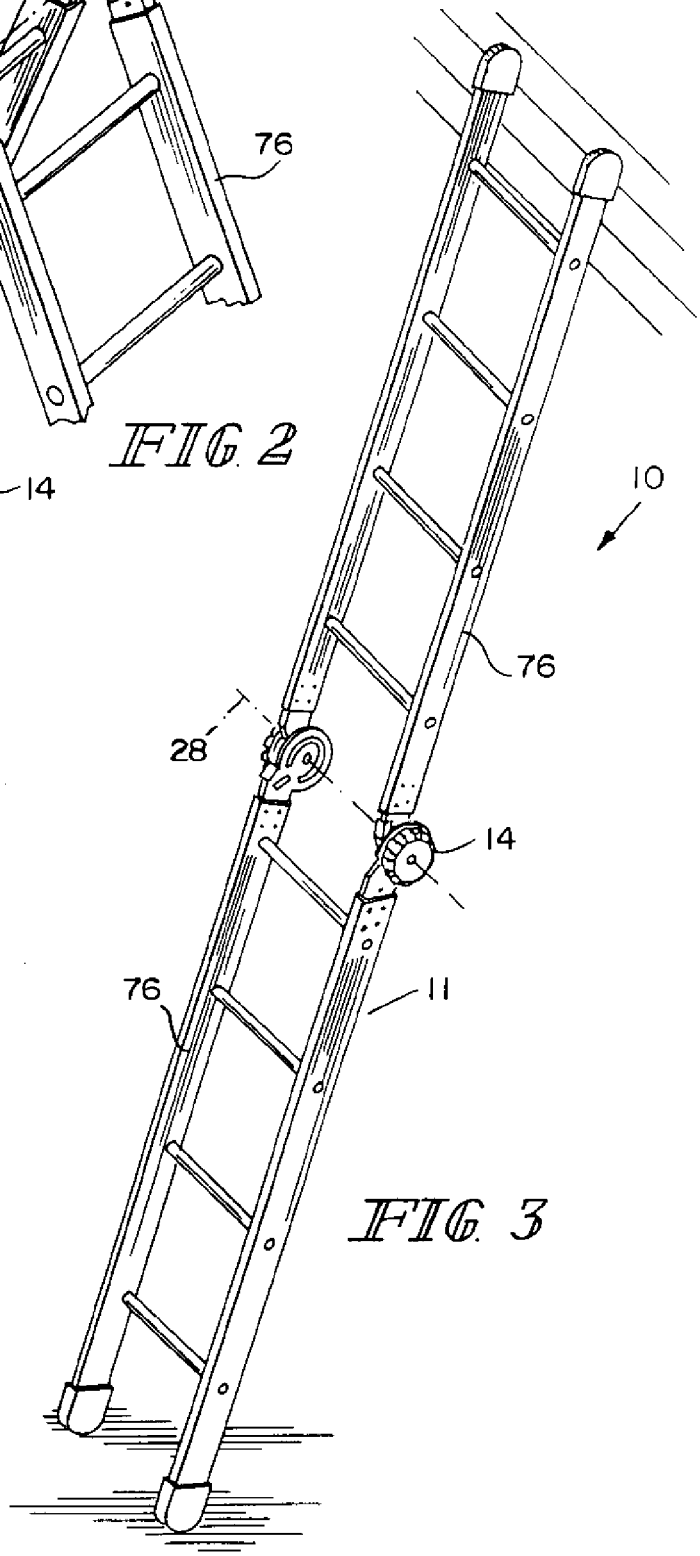
FIG. 3 is a perspective view of the ladder of FIG. 1 showing the ladder in a straight-ladder position and the lockable hinge locked to establish an angle of about 180° between the ladder-leg sections.

A ladder 11 includes a pair of ladder-leg sections 76 and a pair of lockable ladder hinges 10 coupled to sections 76 as shown, for example, in FIGS. 1–3. Hinges 10 are configured to allow selective movement of sections 76 between a closed-ladder (e.g., 0°) position shown in FIG. 1, a trestle-ladder (e.g., 40°) position shown in FIG. 2, and a straight-ladder (e.g., 180°) position shown in FIG. 3 and to lock sections 76 in such positions. As suggested in the embodiment of FIGS. 4–15, a first lockable ladder hinge 10, in accordance with a first embodiment of the disclosure, includes a mounting member 44 for use in coupling an actuator 14 to a lock 12. As suggested in the embodiment of FIGS. 16–23, a second lockable ladder hinge 210, in accordance with a second embodiment of the disclosure, includes a mounting member assembly 244 for use in coupling actuator 214 to lock 12.

Figure 4:
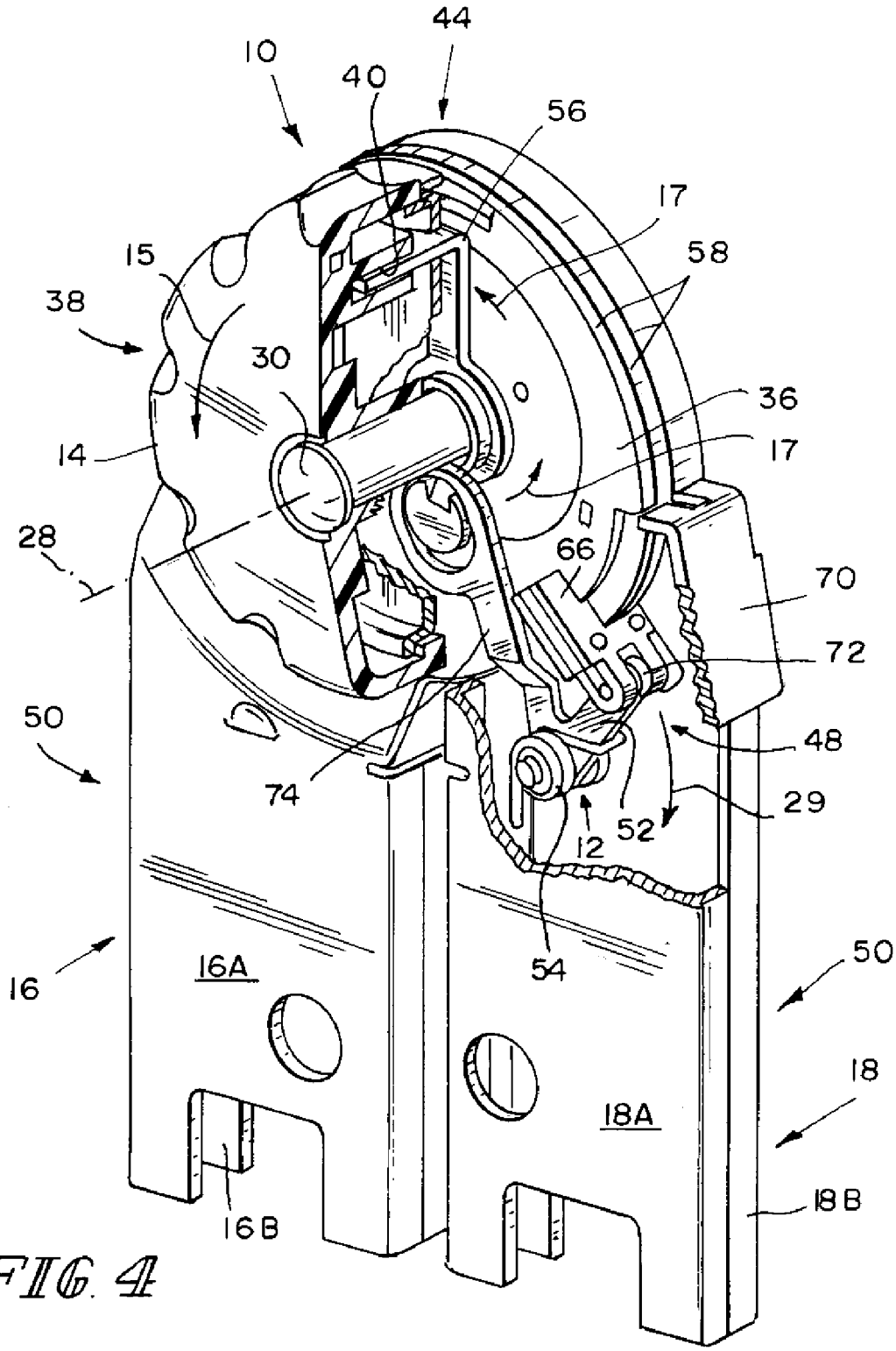
FIG. 4 is an enlarged perspective view of the lockable ladder hinge, with portions broken away showing an actuator, a lock, and a first embodiment of means for coupling the actuator to the lock.

Each hinge 10 includes a lock 12, an actuator 14, and first and second hinge members 16, 18, adapted to be coupled to sections 76, as shown, for example in FIGS. 3 and 4. Lock 12 is used to lock members 16, 18 and sections 76 in the closed-ladder, trestle-ladder, and straight-ladder positions. A user operates actuator 14 to unlock lock 12 to allow selective movement of members 16, 18 and sections 76 between the ladder positions.

Illustratively, a user is able to lock hinge members 16, 18 to cause ladder-leg sections 76 to lock. Three locked positions are possible. A closed-ladder position having an included angle of about 0° between ladder-leg sections, a trestle-ladder position having an included angle of about 40° between ladder-leg sections, or a straight-ladder position having an angle of about 180° between ladder-leg sections.

Figure 5:
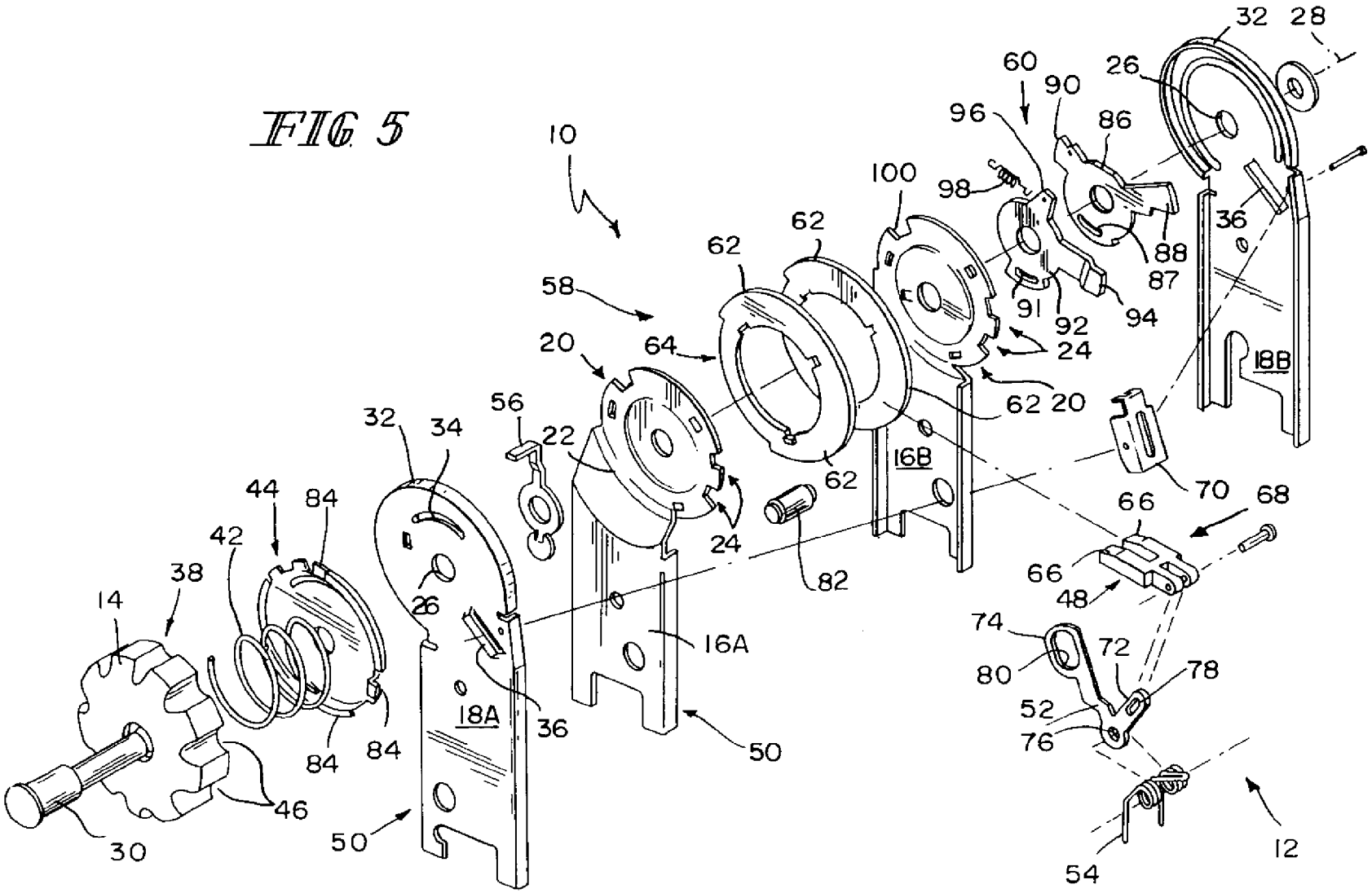
FIG. 5 is an exploded perspective view of the lockable ladder hinge showing (from left to right) a rotary actuator, a front segment of a second hinge member, a front segment of a first hinge member, a pair of guide rings, a lock, a rear segment of the first hinge member, a guide assembly, and a rear segment of the second hinge member.

First hinge member 16 includes an annular flange portion 20 and an attachment arm portion 50, as shown best in FIG. 5. First hinge member 16 is coupled to second hinge member 18 for rotation about a common axis 28. Annular flange portion 20 is coupled on a perimeter edge portion 22 to attachment arm portion 50. Annular flange portion 20 is formed to include a plurality of tab-receiving spaces 24 and a common axis bore 26 formed to receive an axis shaft 30. Illustratively, first hinge member 16 is arranged as two segments 16A and 16B. Each segment 16A, 16B has the annular flange portion 20 and attachment arm portion 50. Segments 16A, 16B are configured to be coupled together to form the hinge member 16.

First hinge member 16 further includes a plurality of guide rings 58 arranged in registered relationship with annular flange portions 20. Guide rings 58 are formed to include an arcuate slide portion 62 formed on a perimeter of each guide ring and an arcuate mounting notch 64 formed on the perimeter of each guide ring 58 and configured to cooperate with a portion of attachment arm portion 50 to block rotation of guide ring 58 relative to annular flange portion 20. Illustratively, a pair of guide rings 58 are arranged in registered relationship between segments 16A and 16B and are concentric to common axis 28. Each guide ring 58 has a larger radius along arcuate slide portion 62 than annular flange portion 20, and is arranged to receive a portion of lock 12 for slidable movement of lock 12 along the arcuate slide portion 62.

Second hinge member 18 includes a cylindrical outer housing 32, an actuator receiver 34, common axis bore 26, a slide channel portion 36, an attachment arm portion 50, and a retention clamp 70, as shown, for example, in FIG. 5. Illustratively, actuator receiver 34 is an arcuately-shaped oblong aperture 34 arranged to receive a portion of lock 12 coupled to actuator 14. Annular flange portion 20 is arranged to nest within cylindrical outer housing 32 such that flange portion 20 and outer housing 32 are concentric to common axis 28. Illustratively, second hinge member 18 is arranged as two segments 18A and 18B. Each segment 18A, 18B has the cylindrical outer housing portion 32 and attachment arm portion 50. Segments 18A, 18B are configured to be coupled together to form the hinge member 18. Retention clamp 70 is a U-shaped bracket 70 and is coupled to an outer portion of segments 18A and 18B to retain the segments 18A and 18B as a unitary member.

Figure 6:
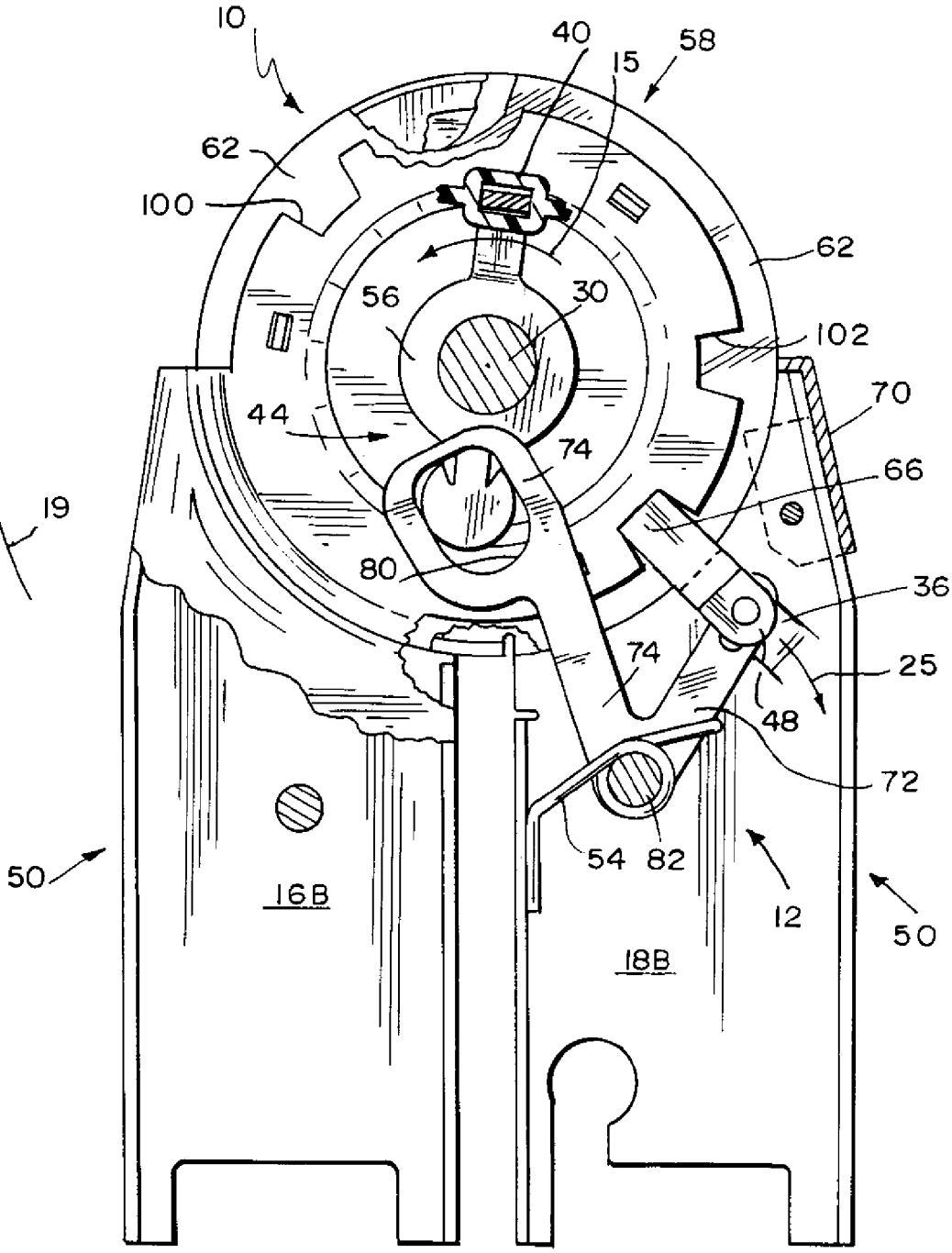
FIGS. 6–9 show movement of components included in the lockable ladder hinge as the hinge is moved from the closed-ladder (0°) position to the trestle-ladder (40°) position.

Second hinge member 18 is formed to include slide channels 36 on interior facing portions of attachment arm 50, as shown, for example, in FIG. 6. Lock 12 is arranged to be received by slide channels 36 for slidable radial movement of lock 12 relative to common axis 28.

Actuator 14 includes a cylindrical housing portion 38, a common axis bore 26, an actuator connector receiver 40 formed on an interior portion of actuator 14, a biasing member 42, a mounting member 44, and a plurality of connecting tabs 46 projecting radially inwardly from an interior wall of cylindrical housing portion 38, as shown, for example, in FIGS. 4 and 5. Illustratively, actuator 14 is a knob arranged for rotary movement about common axis 28. Cylindrical housing portion 38 is arranged to couple to mounting member 44 for rotary movement of knob 14 relative to member 44. In the illustrated embodiment, biasing member 42 is a helical spring and is arranged concentric to common axis 28 between knob 14 and mounting member 44. Spring 42 biases knob 14 away from lock 12 to block rotary movement of knob 14 relative to mounting member 44. Upon coaxial linear movement of knob 14 relative to common axis 28, knob 14 is unlocked from mounting member 44 and is able to be rotated in a first direction 15 to cause lock 12 to move radially outwardly away from common axis 28 and out of tab-receiving spaces 24 in direction 25 to unlock hinges 16 and 18 and allow rotation of hinge members 16, 18 relative to common axis 28.

Lock 12 is coupled to second hinge member 18 and includes a cam 48, a cam link 52, a spring 54, and an actuator connector link 56, as shown best in FIG. 5. Cam 48 is formed to include a pair of tabs 66 formed on a distal end of cam 48 and a U-shaped aperture 68 therebetween. Tabs 66 are arranged to be received by tab-receiving spaces 24 formed in annular flange portion 20 upon movement of cam 48 radially inwardly toward common axis 28 in direction 27. U-shaped aperture 68 is arranged to be received by arcuate slide portion 62 formed on guide ring 58 for slidable movement of cam 48 along arcuate slide portion 62. Cam 48 is coupled on a proximal end to cam link 52.

Cam link 52 includes two arms 72, 74 and is generally V-shaped, as shown best in FIG. 6. Cam link first arm 72 is formed to include an oblong aperture 78 and is configured to receive the proximal end of cam 48 for radial movement of cam 48 relative to common axis 28. Cam link second arm 74 is arranged having a generally D-shaped aperture 80 formed on an end portion of second arm 74 and is configured to be coupled to actuator connector link 56. Cam link 52 is further configured to have a pivot aperture 76 arranged to be coupled to (e.g., receive) a pivot post 82 in an interior portion of attachment arm 50 for pivotable movement thereabout in response to rotary movement of actuator connector link 56 in direction 17 to cause cam 48 to move relative to common axis 28.

Figure 8:
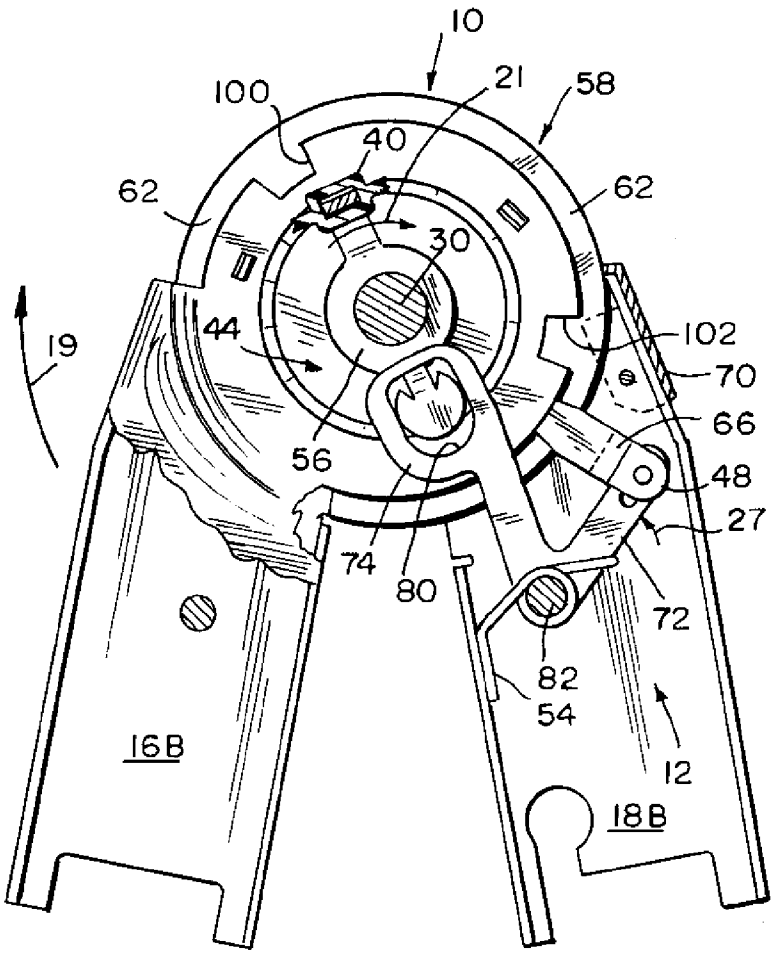
Figure 9:
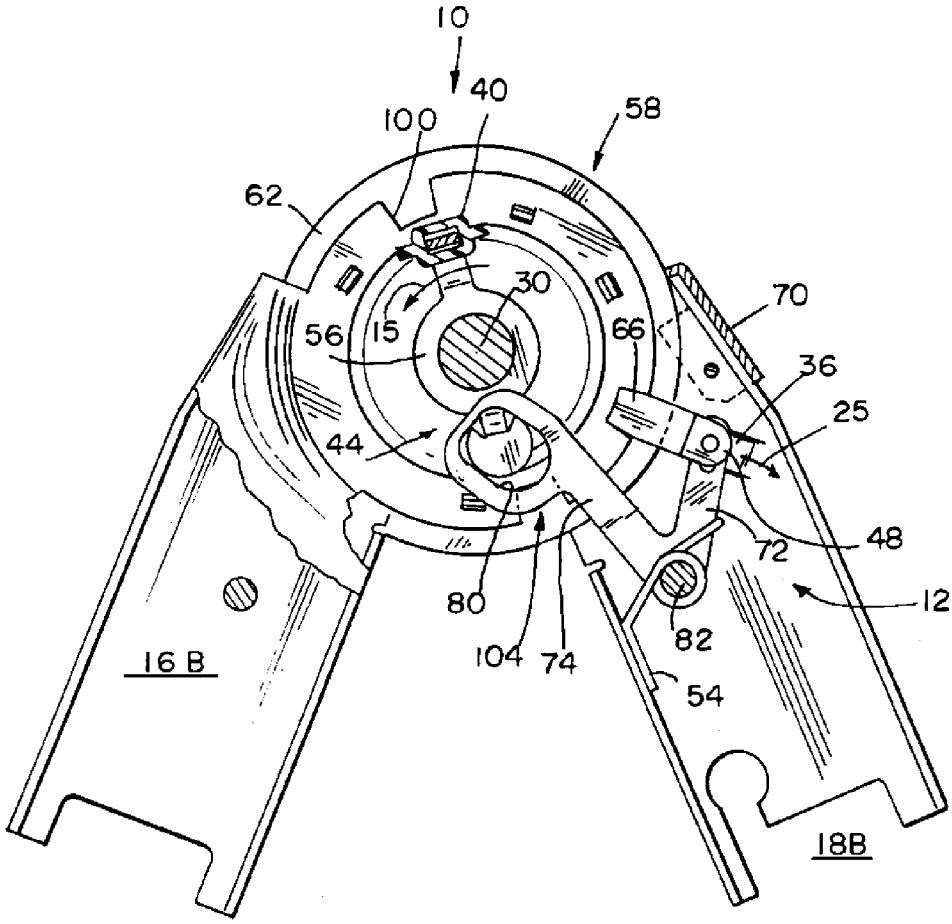
Figure 11:
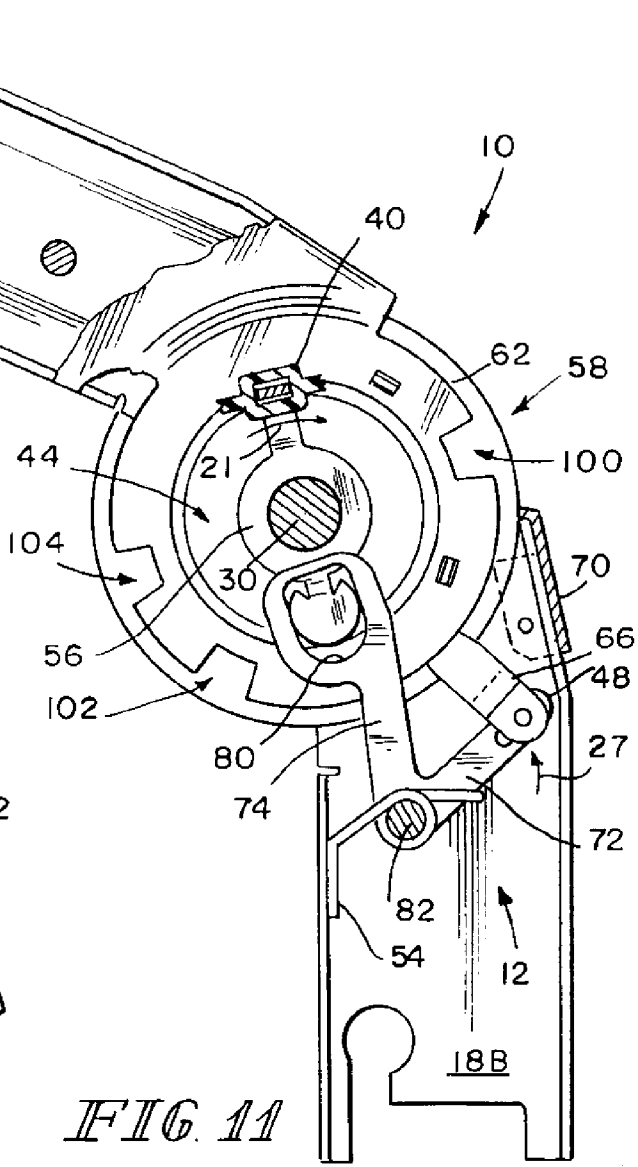
FIGS. 10–12 show movement of components included in the lockable ladder hinge as the hinge is moved from the trestle-ladder (40°) to the straight-ladder (180°)

Spring 54 is further arranged to urge cam link 52 to rotate to cause cam 48 to extend radially inwardly toward common axis 28 against annular flange portion 38 in direction 27, as shown, for example, in FIGS. 8 and 9. Upon rotation of first and second hinge members 16, 18 about common axis 28, tab-receiving spaces 24 align with and are able to receive tabs 66.

Upon movement of tabs 66 into tab-receiving space 24, movement of first hinge member 16 and second hinge member 18 is blocked as shown, for example, in FIG. 6. Each tab-receiving space 24 is associated with one of the locked positions of hinge 10 to allow ladder-leg sections 76 to be arranged in the closed-ladder, trestle-ladder, or straight-ladder positions.

Mounting member 44, actuator connector link 56, cam link 52, and axis shaft 30 thus cooperate to provide means for coupling knob 14 to cam 48 so that, when knob 14 is moved in a first direction 15, cam 48 moves radially outwardly relative to common axis 28 to cause tabs 66 to withdraw from tab-receiving space 24 to allow pivotable movement of first hinge member 16 relative to second hinge member 18. When knob 14 is moved in a second direction 21, cam 48 moves radially inwardly relative to common axis 28 to cause tabs 66 to move into tab-receiving space 24 to block pivotable movement of first hinge member 16 relative to second hinge member 18. Referring now to FIG. 5, axis shaft 30 is arranged to extend from an exterior surface of actuator knob 14 through a middle portion of spring 42 through the common axis bore 26 formed in mounting member 44, and first and second hinge members 16, 18.

Upon pivotable movement of ladder-leg sections 76, first hinge member 16 rotates in direction 19 to cause cam 48 to be urged against arcuate slide portion 36 until tabs 66 are again able to align with one of tab-receiving spaces 24 and move radially inwardly toward common axis 28 to enter tab-receiving spaces 24.

Figure 7:
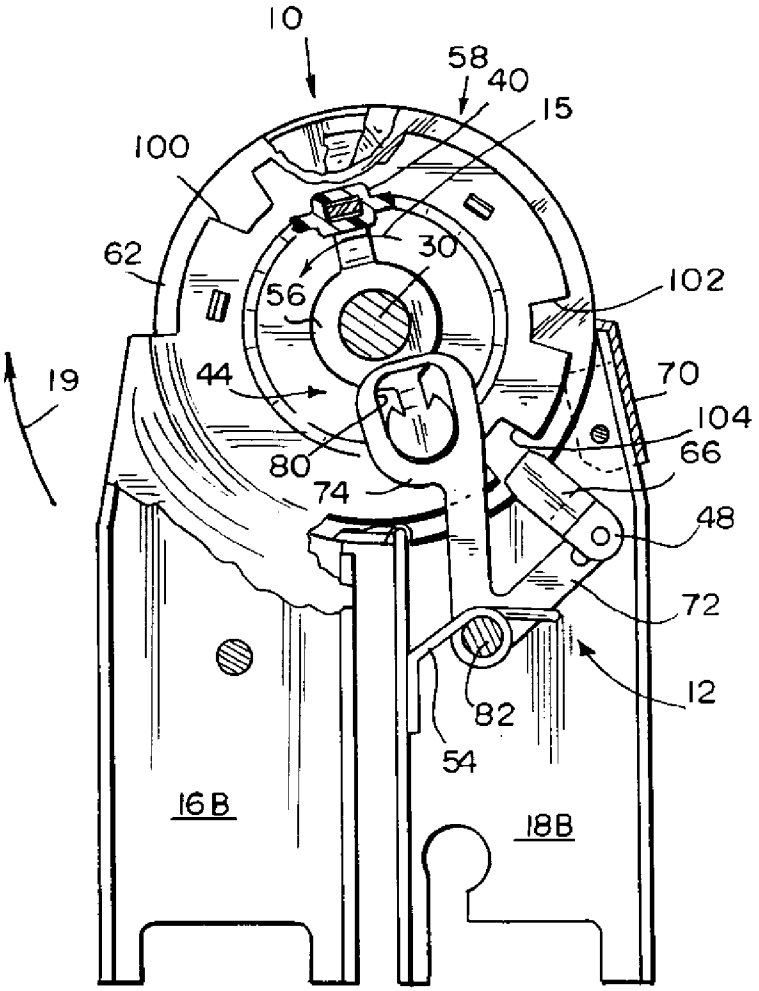
Figure 10:
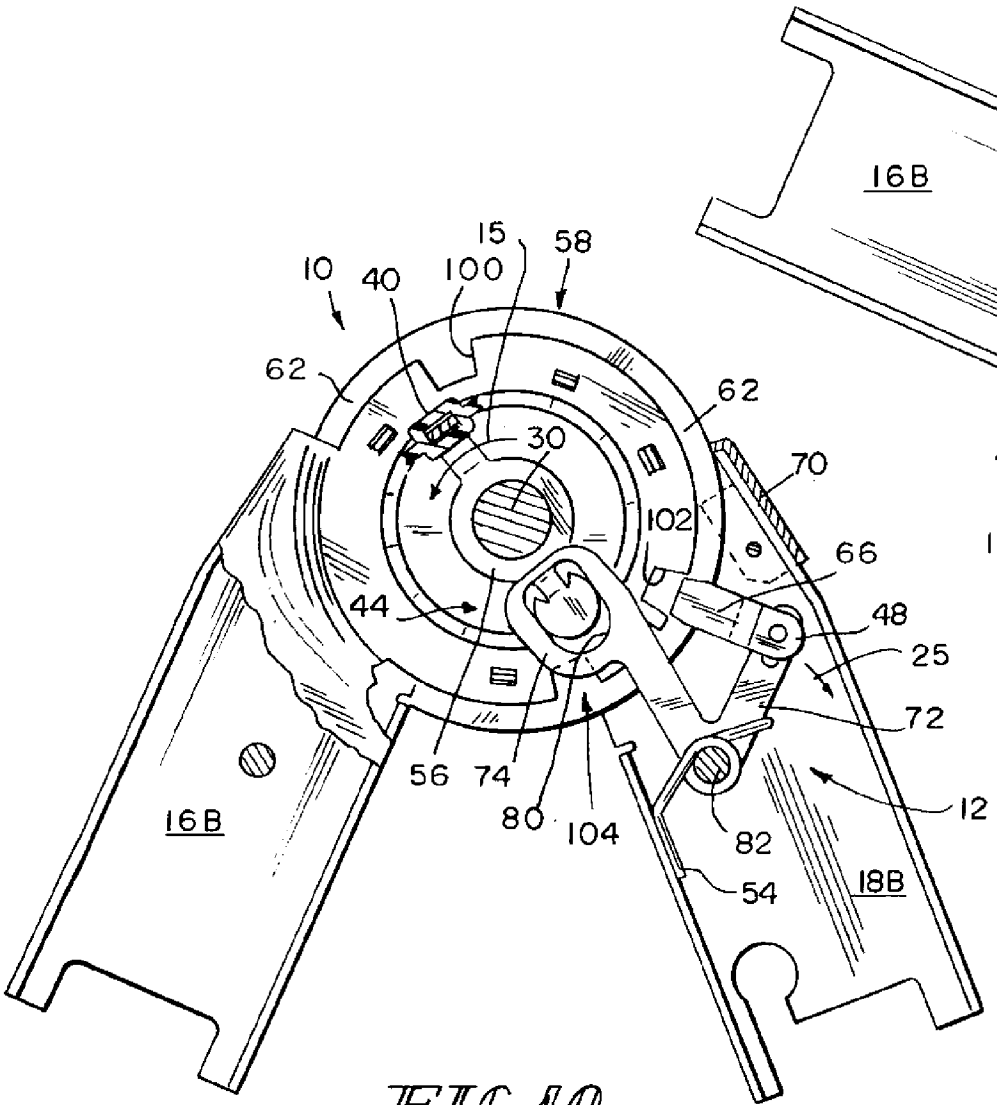

To move ladder-leg sections 76 from the closed-ladder position shown in FIGS. 6 and 7, to the trestle-ladder position, shown in FIGS. 2, 9, and 10, knob 14 is rotated from the first position to the second position and hinge member 16 is moved in direction 19, as suggested in FIGS. 7 and 8. Upon rotation of knob 14, cam link 52 rotates in direction 29 to cause cam 48 to move radially outwardly away from common axis 28 wherein tabs 66 withdraw from tab-receiving spaces 24 as shown, for example, in FIG. 8. When knob 14 is rotated to the second position, mounting member 44 engages and cooperate with knob locking tabs 46 to retain knob 14 momentarily in the second position and retain cam 48 in a retracted position, away from common axis 28. When lock 12 is retained momentarily in the second position, first and second hinge members 16 and 18 are free to pivot relative to one another, and thus a user is able to move ladder-leg sections 76 to the trestle-ladder position, as suggested in FIGS. 8–10.

Figure 12:
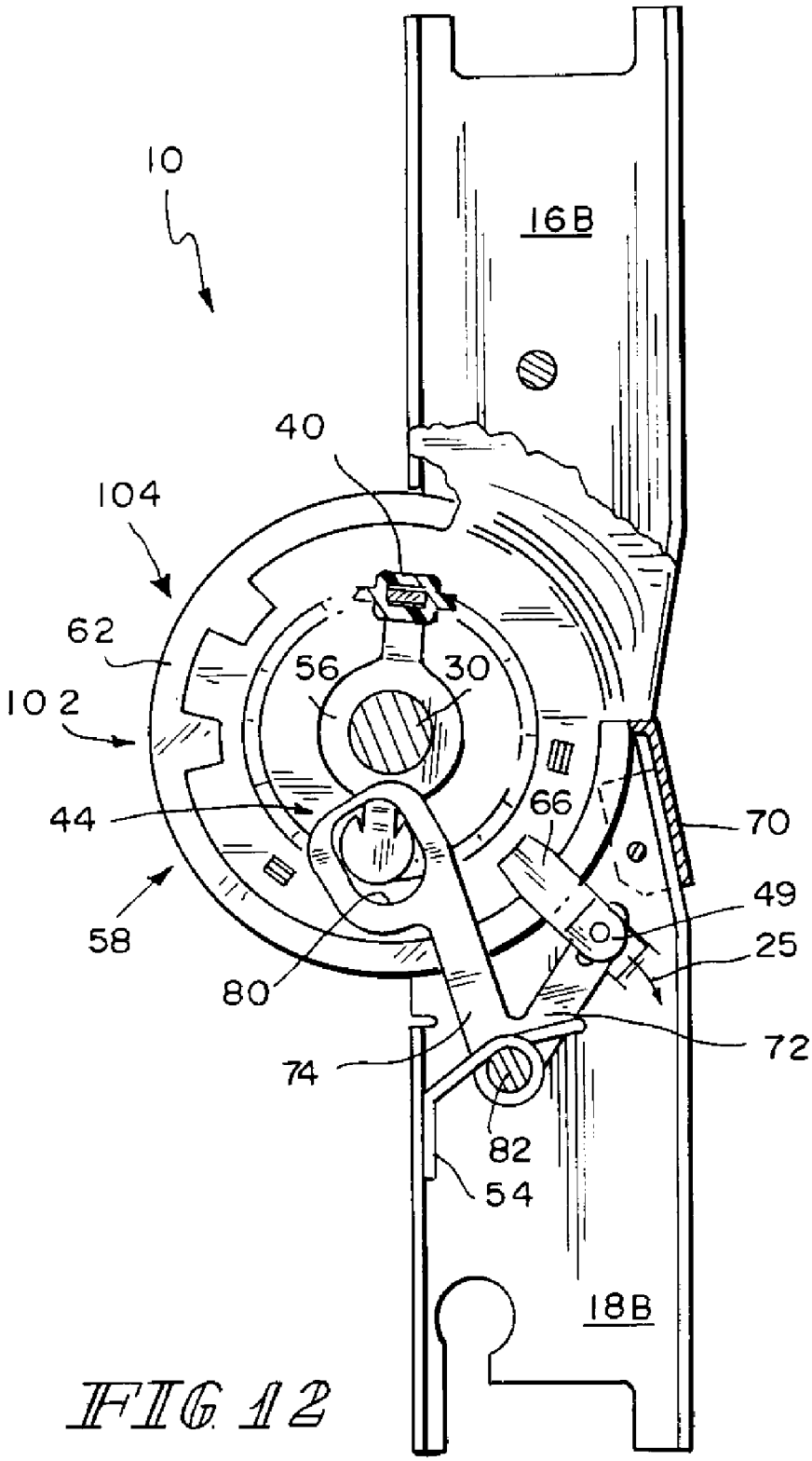
Figure 13:
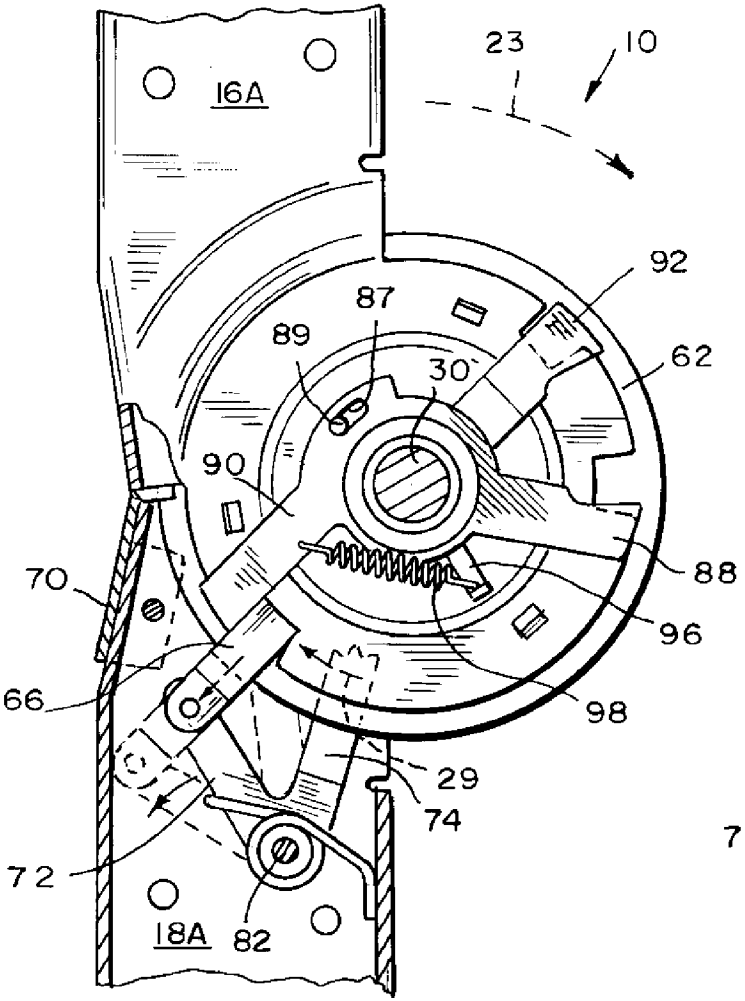
FIG. 13 is a reverse side elevation view of the lockable ladder hinge, with portions broken away, showing in solid, the hinge locked in the straight-ladder (180°) position and showing, in phantom, unlocking of the hinge to allow movement of the hinge back to either the closed-ladder (0°) position or the trestle-ladder (40°) position.

To move ladder-leg sections 76 from the trestle-ladder position shown in FIGS. 9 and 10, to the straight-ladder position, shown in FIGS. 3, 12, and 13, knob 14 is rotated from the first position to the second position, as suggested in FIG. 9. Upon rotation of knob 14, actuator connector link 56 rotates about common axis 28 to cause cam link 52 to pivot to move cam 48 radially outwardly away from common axis 28 wherein tabs 66 withdraw from tab-receiving spaces 24 as shown, for example, in FIG. 12. When knob 14 is rotated to the second position, mounting member retainer ridges 84 engage and cooperate with lock tabs 46 to retain knob 14 momentarily in the second position and retain cam 48 in a retracted position, away from common axis 28. When lock 12 is retained momentarily in the second position, first and second hinge members 16 and 18 are free to pivot relative to one another, and thus a user is able to move ladder-leg sections 76 to the straight-ladder position, as suggested in FIGS. 10–12.

With respect to lockable hinge 10, knob 14, actuator connector link 56, and cam link 52 cooperate to provide means for coupling knob 14 to cam 48 so that, when knob 14 is moved in a first direction 15, cam 48 moves radially outwardly relative to common axis 28 to cause tabs 66 to move away from tab-receiving spaces 24 to allow pivotable movement of first hinge member 16 relative to second hinge member 18. Lockable hinge 10, knob 14, actuator connector link 56, and cam link 52 cooperate to provide means for coupling knob 14 to cam 48 so that, when knob 14 is moved in a second direction, cam 30 moves radially inwardly relative to common axis 28 to cause tabs 66 to move toward tab-receiving spaces 24 to block pivotable movement of first hinge member 16 relative to second hinge member 18.

Figure 14:
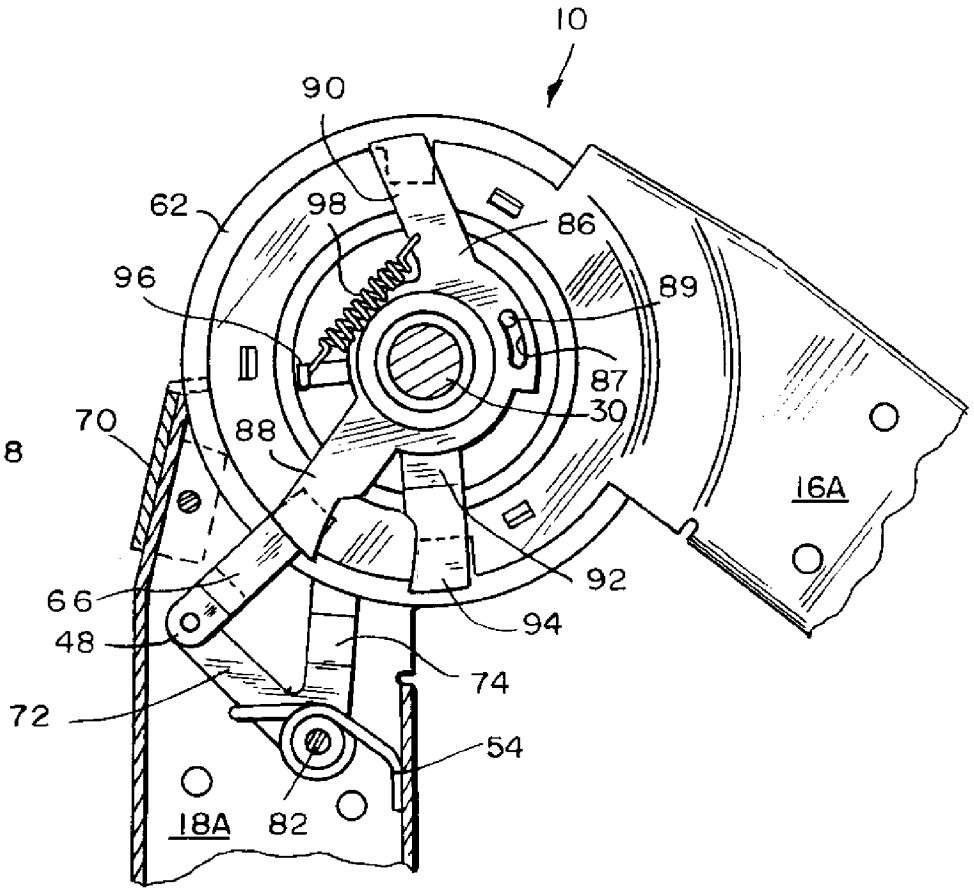
FIG. 14 is a reverse side elevation view of the lockable ladder hinge, with portions broken away, showing the position of a guide assembly when the hinge is positioned in the trestle-ladder (40°) position.
Figure 15:
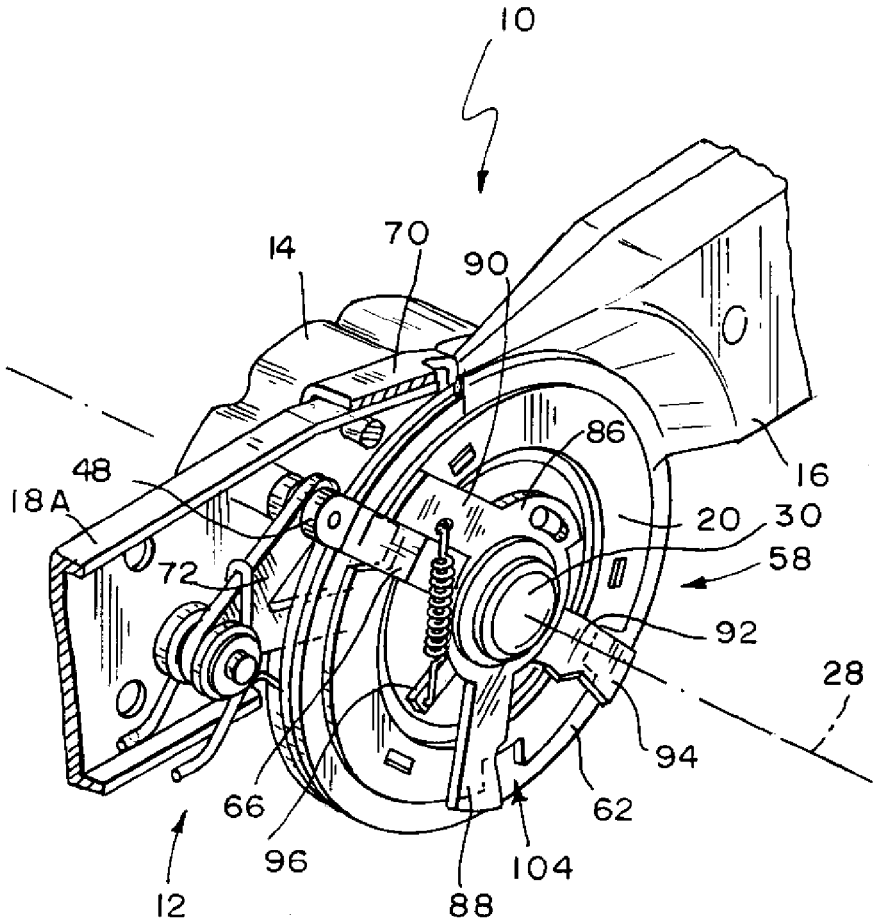
FIG. 15 is a perspective view of the ladder hinge, with portions broken away, showing the guide assembly position when the hinge is positioned in the straight-ladder (180°) position.

A guide assembly 60 shown in FIGS. 13–15 is configured to guide movement of cam 48. Assembly 60 includes a first guide 86, a second guide 92, and a spring 98. First guide 86 and second guide 92 are arranged in side-by-side relationship between hinge member segment 16B and hinge member segment 18B and concentric to common axis 28 for rotary movement about common axis 28. First guide 86 includes a first arm 88, a second arm 90, and a first arc-shaped slide slot 87. Second guide 92 includes a third arm 94, a spring retainer 96, and a second arc-shaped slide slot 91. Annular flange portion 20 includes a tab 89 extending into the first and second arc-shaped slide slots 87 and 91, the first and second arc-shaped slide slots 87, 91 overlap one another such that tab 89 defines the limits of rotary movement of first guide 86 and second guide 92. In the illustrated embodiment, spring 98 is a helical spring coupled to a second arm 90 on a first end and to spring retainer 96 on a second end.

When ladder-leg sections 76 are arranged in the straight ladder position, an end portion of first arm 88 is urged against cam 48 by spring 98 as shown, for example, in FIG. 15. When knob 14 is rotated from the first position to the second position, actuator connector link 56 rotates about common axis 28 to cause cam link 52 to pivot to move cam 48 radially outwardly away from common axis 28 wherein tabs 66 withdraw from tab-receiving spaces 24. As tabs 66 are withdrawn from tab-receiving spaces 24, first guide 86 is able to rotate to cause second arm 90 to block a tab-receiving space 100 formed in annular flange portion 20 and associated with locking hinge members 16, 18 in the straight-ladder position. Second arm 90 blocks cam 48 from re-engaging tab-receiving space 100 so that hinge member 16 can be rotated in direction 23 relative to hinge member 18 about common axis 28 to either the trestle-ladder or closed-ladder positions. As second arm 90 moves to block tab-receiving space 100, first arm 88 moves to a tab-receiving space 102 formed in annular flange portion 20 and associated with locking hinge members 16, 18 in the trestle-ladder position.

First arm 88 is configured having an oblique arcuate surface at the end portion of arm 88. This configuration allows cam 48 to slide under the end portion of arm 88 as hinge members 16, 18 are rotated to the trestle ladder position. If the hinge members are then rotated in the opposite direction, the cam 48 will then engage the end portion of first arm 88 causing arm 88 to rotate slightly exposing tab-receiving space 102 to allow cam 48 to move radially inwardly toward common axis 28 and engage tab-receiving space 102 to block movement of hinge members 16, 18 relative to one another.

To move ladder legs 76 to the closed-ladder position, knob 14 is rotated from the first position to the second position. Upon rotation of knob 14, cam 48 moves radially outwardly away from common axis 28 wherein tabs 66 withdraw from tab-receiving space 102. As hinge members 16, 18 are rotated toward one another, cam 48 confronts an end portion of guide arm 94 of second guide 92. Rotation of hinge members 16, 18 causes cam 48 to rotate guide arm 94 to expose a tab-receiving space 104 formed in annular flange portion 20 and associated with the closed-ladder position. When space 104 is fully exposed, cam 48 is able to engage space 104 to block movement of hinge members 16, 18 relative to one another. As guide arm 94 is rotated to expose space 104, spring 98 urges first guide to rotate relative to common axis 28 and arm 90 to block tab-receiving space 100 and arm 88 to block tab-receiving space 102.

Figure 16:
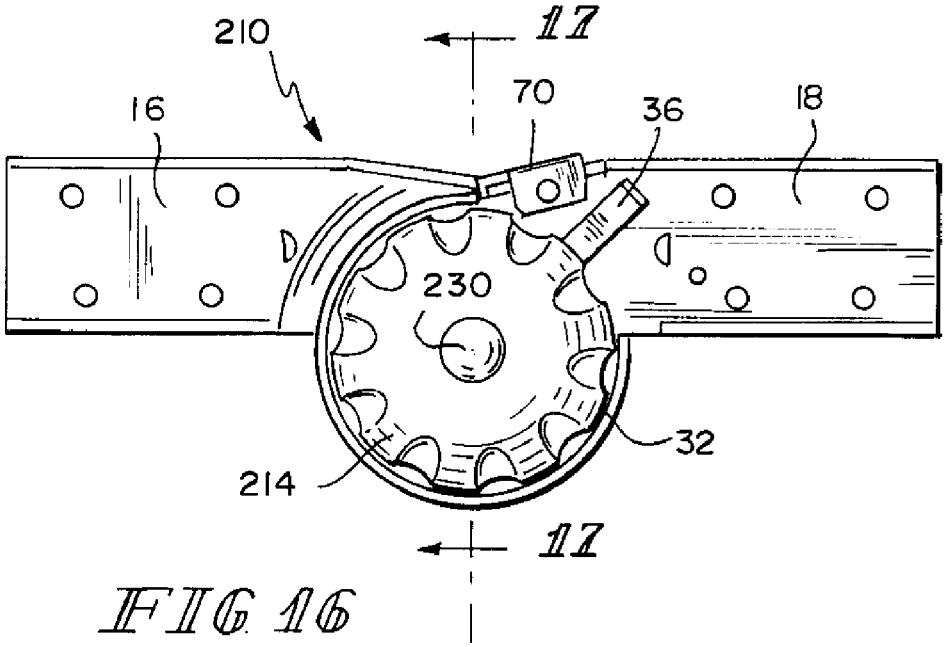
FIG. 16 is a side elevation view of a second lockable ladder hinge.
Figure 17:
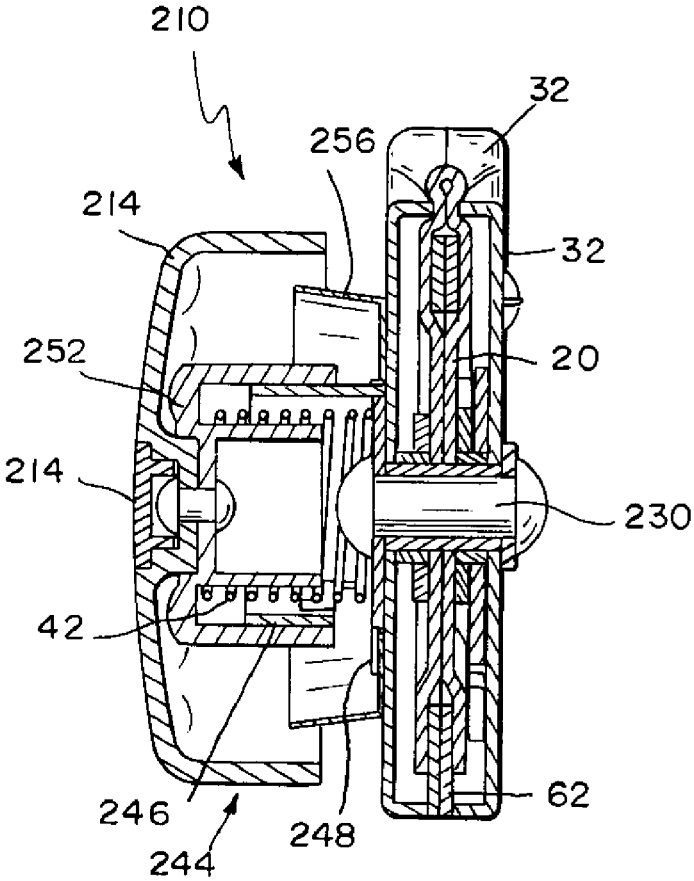
FIG. 17 is a sectional view taken along lines 17—17 of FIG. 16 showing the actuator, the lock, and a second embodiment of the means for coupling the actuator to the lock.

Another lockable ladder hinge 210 for use with ladder 11 in place of each hinge 10 is shown, for example, in FIGS. 16 and 17 performs the same function as lockable ladder hinge 10. Hinge 210 has components similar to components of hinge 10 so that identical reference numbers refer to similar components. Hinge 210 is different from the hinge 10 in the way its actuator 214 is coupled to cam 48.

Figure 18:
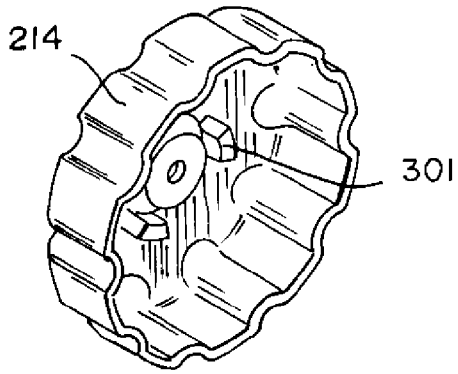
FIG. 18 is a perspective view of an actuator of the second ladder hinge.

Actuator 214 includes a cylindrical housing portion 238, a common axis bore 26, and a plurality of mating posts 301 as shown best in FIG. 18. Illustratively, actuator 214 is a rotary knob. Knob 214 is arranged to couple to mounting member assembly 244 for rotary movement of knob 214 relative to hinge members 16, 18 to cause lock 12 to block or allow movement of hinge members 16, 18 relative to one another in response to a user's input.

Mounting member assembly 244 includes a cylindrical body 246, an annular retainer plate 248, a connector sleeve 252, a spring 42, and a mounting member housing 256 as shown, for example in FIGS. 18–23 Connector sleeve 252 is formed to include a plurality of mating apertures 262 and is arranged to receive mating posts 301 to couple connector sleeve 252 to an inner surface of knob 214 in concentric relation to common axis 28.

An actuator connector link receiver 240 is formed on a perimeter surface of connector sleeve 252 to receive a portion of actuator connector link 56. Connector sleeve 252 is further arranged to receive a first end portion of cylindrical body 246 and spring 42 therebetween as shown, for example, in FIG. 21. Connector sleeve 252 is further formed to include a plurality of hook-shaped radially inwardly facing projections 253 which align with and couple to a plurality of notches 247 formed in cylindrical body 246.

Figure 19:
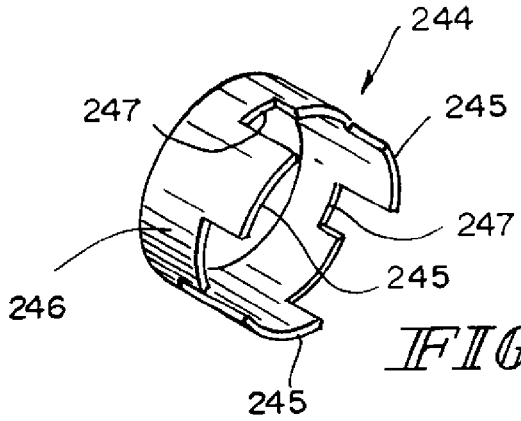
FIG. 19 is a perspective view of a cylindrical body of the second ladder hinge.

Cylindrical body 246 includes a plurality of arcuate projections 245 arranged to receive arcuate notches 250 formed on the perimeter of retainer plate 248 to couple cylindrical body 246 to annular retainer plate 248 so that body 246 is in a fixed position relative to hinge member 18 as shown, for example, in FIG. 19. Mounting member housing 256 is formed to include a notch 264 on a perimeter edge to receive a portion of slide channel 36 formed in hinge member 18 to couple mounting member housing 256 to an outer surface of second hinge member 18 so that mounting member housing 256 is in a fixed position relative to hinge member 18. Mounting member housing 256 is further formed to include an oblong arcuate aperture to allow a portion of actuator connector 56 to pass through mounting member housing 256 for coupling to actuator receiver 240.

Figure 20:
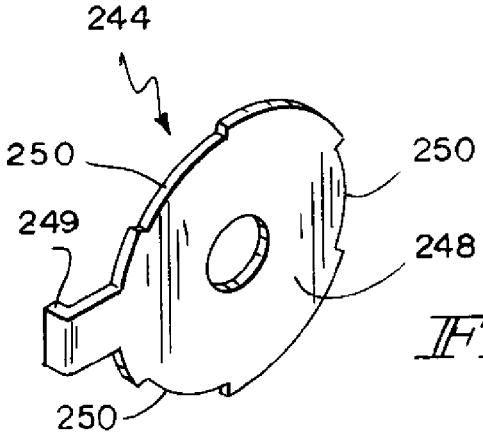
FIG. 20 is a perspective view of an annular retainer plate of the second ladder hinge.
Figure 21:
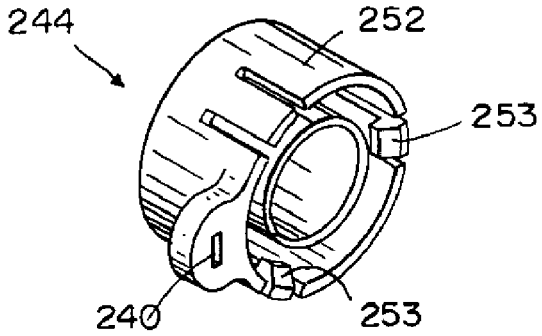
FIG. 21 is a perspective view of a connector sleeve of the second ladder hinge.
Figure 22:
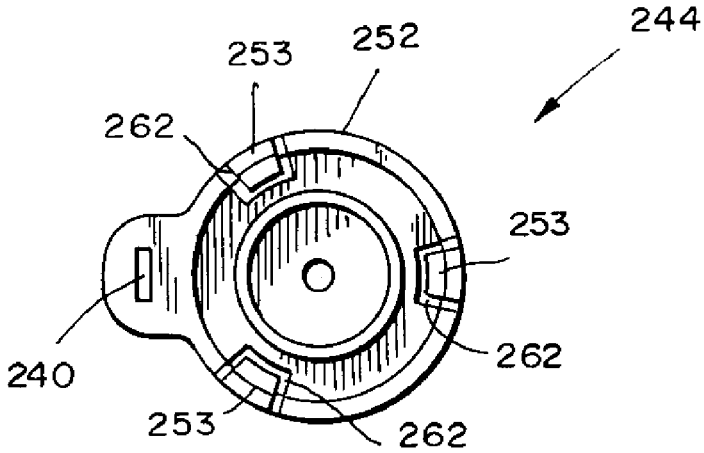
FIG. 22 is a plan view of the connector sleeve of the second ladder hinge.
Figure 23:
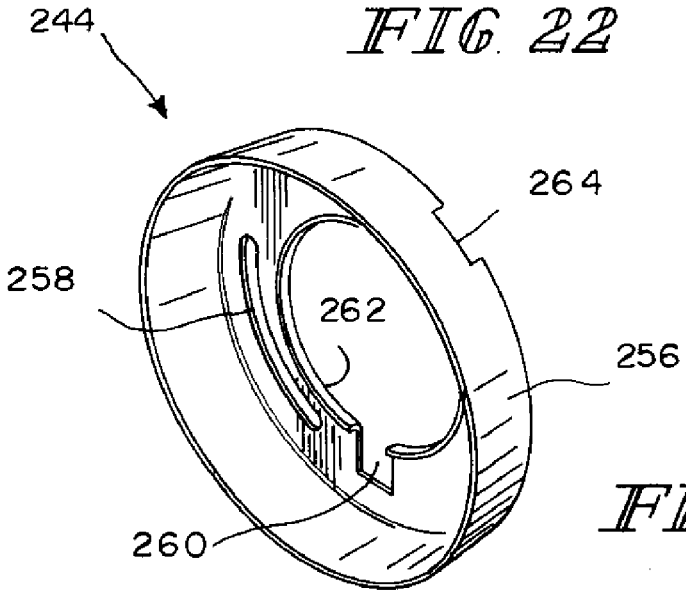
FIG. 23 is a perspective view of a mounting member housing of the second ladder hinge.

Retainer plate 248 is formed to include a lock notch 249 which is arranged to project through an aperture 262 formed in mounting member housing 256. Retainer plate 248 is further arranged to couple to second hinge member 18 to block rotary movement of annular plate 248, and cylindrical body 246 as shown in FIG. 20.

Spring 42 is arranged concentrically to common axis 28 between connector sleeve 252 and annular retainer plate 248. Spring 42 biases knob 214 away from lock 12 to block rotary movement of knob 214 relative to mounting member assembly 244. Upon coaxial linear movement of knob 214 relative to common axis 28, knob 214 is unlocked from mounting member assembly 244 and is able to be rotated in a first direction 15 to cause lock 12 to move radially outwardly away from common axis 28 and out of tab-receiving spaces 24 to unlock hinges 16 and 18 and allow rotation of hinge members 16, 18 relative to common axis 28.

Cylindrical body 246, annular retainer plate 248, connector sleeve 252, spring 42, actuator connector link 56, cam link 52, and mounting member housing 256 thus cooperate to provide means for coupling actuator 214 to cam 48 so that, when knob 14 is moved in a first direction 15, cam 48 moves radially outwardly relative to common axis 28 to cause tabs 66 to withdraw from tab-receiving space 24 to allow pivotable movement of first hinge member 16 relative to second hinge member 18. When knob 14 is moved in a second direction, cam 48 moves radially inwardly relative to common axis 28 to cause tabs 66 to move into tab-receiving space 24 to block pivotable movement of first hinge member 16 relative to second hinge member 18. Referring now to FIG. 5, axis shaft 30 is arranged to extend from an exterior surface of actuator knob 14 through a middle portion of spring 42 through the common axis bore 26 formed in mounting member 44, and first and second hinge members 16, 18.

The invention claimed is:

1. A lockable ladder hinge comprising first and second hinge members coupled together for rotation about a common axis, a cam having a pair of tabs coupled to the second hinge member, the first hinge member having tab-receiving spaces, an actuator, means for coupling the actuator to the cam so that, when the actuator is moved in a first direction, the cam moves outwardly relative to the common axis to cause the pair of tabs to withdraw from the tab-receiving spaces to unlock the hinge members, and so that, when the actuator is moved in a second direction opposite to the first direction, the cam moves inwardly relative to the common axis to cause the pair of tabs to enter the tab-receiving spaces to lock the hinge members, the means for coupling the actuator to the cam includes a mounting member, an actuator connector link, and a cam link, the actuator connector link is coupled through the mounting member to the actuator to rotate in the first direction about the common axis for radial movement of the tabs away from the common axis to withdraw the tabs from the tab-receiving spaces to allow the second hinge member to pivot relative to the first hinge member and to rotate in the second direction about the common axis for radial movement of the tabs toward the common axis to move the tabs into the tab-receiving spaces to block the second hinge member from pivoting relative to the first hinge member, and wherein the first hinge member includes a first segment, a second segment, and a pair of guide rings, each of the first and second segments is formed to include at an end thereof an annular flange portion, the pair of guide rings are arranged in side-by-side relationship to one another and between the annular flange portions of the first and second segments, and the first and second segments are coupled together to form the first hinge member.

2. The lockable ladder hinge of claim 1, wherein the annular flange portions are formed to include the tab-receiving spaces.

3. The lockable ladder hinge of claim 1, wherein the guide rings have a first radius, the annular flange portions have a second radius, and the first radius is larger than the second radius.

4. The lockable ladder hinge of claim 1, wherein the guide rings cooperate to provide an arcuate slide portion formed on the perimeter of each guide ring, the guide rings are configured to lie in side-by-side relationship to one another, and a U-shaped notch formed between the tabs of the cam is arranged to receive the arcuate slide portion of the guide ring for slidable movement of the cam along the arcuate slide portion during rotation of the first and second hinge members relative to one another.

5. A lockable ladder hinge comprising first and second hinge members coupled together for rotation about a common axis, a cam having a pair of tabs coupled to the second hinge member, the first hinge member having tab-receiving spaces, an actuator, means for coupling the actuator to the cam so that, when the actuator is moved in a first direction, the cam moves outwardly relative to the common axis to cause the pair of tabs to withdraw from the tab-receiving spaces to unlock the hinge members, and so that, when the actuator is moved in a second direction opposite to the first direction, the cam moves inwardly relative to the common axis to cause the pair of tabs to enter the tab-receiving spaces to lock the hinge members, the means for coupling the actuator to the cam includes a mounting member, an actuator connector link, and a cam link, the actuator connector link is coupled through the mounting member to the actuator to rotate in the first direction about the common axis for radial movement of the tabs away from the common axis to withdraw the tabs from the tab-receiving spaces to allow the second hinge member to pivot relative to the first hinge member and to rotate in the second direction about the common axis for radial movement of the tabs toward the common axis to move the tabs into the tab-receiving spaces to block the second hinge member from pivoting relative to the first hinge member, further comprising a guide assembly arranged to guide movement of the cam, wherein the actuator connector link, the cam link, the cam, and the guide assembly cooperate to provide a lock to lock the first and second hinge members in a fixed position relative to one another, and wherein the guide assembly includes a first guide having a first arm and a second arm, a second guide having a third arm and a spring retainer, and a guide spring, the first guide and the second guide are arranged in side-by-side relation to one another for rotary movement about the common axis, and the guide spring is coupled at a first end thereof to the spring retainer and at a second end thereof to the second arm.

6. A lockable ladder hinge comprising first and second hinge members coupled together for rotation about a common axis, a cam having a pair of tabs coupled to the second hinge member, the first hinge member having tab-receiving spaces, an actuator, means for coupling the actuator to the cam so that, when the actuator is moved in a first direction, the cam moves outwardly relative to the common axis to cause the pair of tabs to withdraw from the tab-receiving spaces to unlock the hinge members, and so that, when the actuator is moved in a second direction opposite to the first direction, the cam moves inwardly relative to the common axis to cause the pair of tabs to enter the tab-receiving spaces to lock the hinge members, the means for coupling the actuator to the cam includes a mounting member, an actuator connector link, and a cam link, the actuator connector link is coupled through the mounting member to the actuator to rotate in the first direction about the common axis for radial movement of the tabs away from the common axis to withdraw the tabs from the tab-receiving spaces to allow the second hinge member to pivot relative to the first hinge member and to rotate in the second direction about the common axis for radial movement of the tabs toward the common axis to move the tabs into the tab-receiving spaces to block the second hinge member from pivoting relative to the first hinge member, further comprising a guide assembly arranged to guide movement of the cam, wherein the actuator connector link, the cam link, the cam, and the guide assembly cooperate to provide a lock to lock the first and second hinge members in a fixed position relative to one another, and wherein the guide assembly includes a first guide having a first arm and a second arm, a second guide having a third arm and is arranged for rotation about the common axis and is positioned between an annular flange portion of the first hinge member and an outer housing of the second hinge member.

7. A lockable ladder hinge comprising first and second hinge members coupled together for rotation about a common axis, a cam having a pair of tabs coupled to the second hinge member, the first hinge member having tab-receiving spaces, an actuator, means for coupling the actuator to the cam so that, when the actuator is moved in a first direction, the cam moves outwardly relative to the common axis to cause the pair of tabs to withdraw from the tab-receiving spaces to unlock the hinge members, and so that, when the actuator is moved in a second direction opposite to the first direction, the cam moves inwardly relative to the common axis to cause the pair of tabs to enter the tab-receiving spaces to lock the hinge members, and wherein the actuator includes a link receiver, the means for coupling the actuator to the cam includes an actuator link, and the actuator link is arranged for rotation about the common axis and is coupled to the link receiver and to a cam link coupled to the cam.

8. A lockable ladder hinge comprising first and second hinge members coupled together for rotation about a common axis, a lock having a pair of tabs coupled to the second hinge member, the first hinge member having tab-receiving spaces, and a knob coupled to the lock, the knob being arranged for movement in a first direction about the common axis so that the lock moves radially away from the common axis and the tabs withdraw from the tab-receiving spaces to allow movement of the first and second hinge members relative to one another about the common axis and arranged for movement in a second direction, opposite to the first direction, about the common axis so that the lock moves radially toward the common axis and the tabs are received in the lock-receiving spaces to block movement of the first and second hinge members relative to one another about the common axis, and wherein the lock includes a cam that provides the tabs and the second hinge member is formed to include a cam channel to receive the cam for radial movement relative to the common axis.

9. A lockable ladder hinge comprising first and second hinge members coupled together for rotation about a common axis, a lock having a pair of tabs coupled to the second hinge member, the first hinge member having tab-receiving spaces, and a knob coupled to the lock, the knob being arranged for movement in a first direction about the common axis so that the lock moves radially away from the common axis and the tabs withdraw from the tab-receiving spaces to allow movement of the first and second hinge members relative to one another about the common axis and arranged for movement in a second direction, opposite to the first direction, about the common axis so that the lock moves radially toward the common axis and the tabs are received in the lock-receiving spaces to block movement of the first and second hinge members relative to one another about the common axis, wherein the first hinge member includes a first segment, a second segment, and a pair of guide rings, each of the first and second segments is formed to include at an end thereof an annular flange portion, the pair of guide rings are arranged in side-by-side relationship to one another and between the annular flange portions of the first and second segments, and the first and second segments are coupled together to form the first hinge member, and wherein each guide ring has a first radius, each annular flange portion has a second radius, and the first radius is larger than the second radius.

10. A lockable ladder hinge comprising a hollow right attachment arm and a hollow left attachment arm, the right attachment arm including a cylindrical outer housing arranged at an end of the right attachment arm, the left attachment arm including an annular flange portion arranged at the end of the left attachment arm, the annular flange portion nesting within the cylindrical outer housing and being concentrically arranged with the cylindrical outer housing relative to an axis shaft included in the lockable ladder hinge, the annular flange portion including a circumferential edge formed to include a plurality of tab-receiving spaces, a cam that can fit into the tab-receiving spaces, the cam being arranged within the right attachment arm, the right attachment arm including side walls, each side wall including a slide channel, the cam being set into the slide channels, a cam link including a first end coupled to an end of the cam in a rotatable manner and a middle part coupled to the right attachment arm in a rotatable manner about a bearing pin included in the lockable ladder hinge, a torsion spring that urges the first end of the cam link toward the annular flange portion, the torsion spring being concentrically arranged with the bearing pin, an actuator connector link including a first end movably coupled to the cam link, a middle portion concentrically coupled to the axis shaft for rotation about a common axis defined by the axis shaft, and a second end formed to include a projecting portion that extends outwardly through an arcuately-shaped oblong aperture formed in the cylindrical outer housing, and an actuator that is arranged to rotate about the axis shaft and includes a connector link receiver to couple the actuator connector link to the actuator.

11. The lockable ladder hinge of claim 10, wherein the plurality of tab-receiving spaces includes first, second, and third tab-receiving spaces, the left and right attachment arms are aligned when the cam is received into the first tab-receiving space, define a 0° angle therebetween when the cam is received into the second tab-receiving space, and define an acute angle therebetweeen when the cam is received into the third tab-receiving space.

12. The lockable ladder hinge of claim 11, further comprising a guide assembly including a first guide and a second guide concentrically arranged with one another to rotate about the common axis, wherein the first guide includes a first arm associated with the first tab-receiving space, a second arm associated with the second tab-receiving space, and a first arc-shaped slide slot, the second guide includes a spring retainer, a third arm associated with the third tab-receiving space, and a second arc-shaped slide slot, the annular flange portion including a tab extending into the first and second arc-shaped slide slots, the first and second arc-shaped slide slots overlap one another and the first arm confronts the top of the cam when the cam enters into the first tab-receiving space, a lower edge of the first arm projects beyond the circumferential edge of the annular flange portion, the second arm is arranged on the side of the second tab-receiving space closer to the first tab-receiving space, an end portion of the second arm is formed into an oblique arc surface so that the side of the oblique arc surface closer to the first arm is aligned with the circumferential edge of the annular flange portion or is positioned radially inwardly from the circumferential edge of the annular flange portion, the side of the oblique arc surface closer to the second tab-receiving space projects beyond the circumferential edge of the annular flange portion, the third arm overlies the third tab-receiving space, and a lower edge of the third arm projects beyond the circumferential edge of the annular flange portion so that the spring retainer is located between the first and second arms and a spring is arranged between the first arm and the spring retainer.

13. The lockable ladder hinge of claim 10, further comprising a guide ring and a retention clamp, wherein the annular flange portion includes first and second annular flange portion segments, the guide ring is sandwiched between the first and second annular flange portion segments and has a radius larger than that of the annular flange portion, the guide ring is formed to receive a U-shaped notch formed in the cam between two tabs of the cam, the width of the notch is equal to the thickness of the guide ring, the two tabs are received into the tab-receiving spaces on both sides of the guide ring, an arc-shaped opening is formed in the right attachment arm, and the retention clamp is coupled to the right attachment arm and includes a hook-shaped member which hooks into the arc-shaped opening.

14. The lockable ladder hinge of claim 10, further comprising a mounting member, wherein the mounting member is fixed on an outer side surface of the cylindrical outer housing between the actuator and the outer side surface, the mounting member includes a plurality of engagement tabs, the actuator includes a plurality of hook-shaped elements formed on an inner surface of the actuator, each hook-shaped element is associated with one of the engagement tabs, and an outer surface of the mounting member includes a projecting ear formed to be received by an aperture formed in the cylindrical outer housing.

15. The lockable ladder hinge of claim 14, wherein the mounting member is coupled to the outer side surface of the cylindrical outer housing, the mounting member is formed to include a notch that receives a portion of one of the slide channels, and a portion of the mounting member projects into the actuator.

16. The lockable ladder hinge of claim 14, wherein the actuator includes a knob, the knob and the mounting member are bowl-shaped so that open ends of the knob and the mounting member face one another, the mounting member has a smaller diameter than a diameter of the knob and is arranged to nest within the knob, the actuator includes a compression spring arranged between the knob and the mounting member to urge the knob away from the mounting member.

* * * * *